United States Patent [19]

Nolan et al.

[11] Patent Number: 4,804,886

[45] Date of Patent: Feb. 14, 1989

[54] ELECTRIC LAMP WITH COMPOSITE SAFETY COATING AND PROCESS OF MANUFACTURE

[75] Inventors: James D. Nolan, 624 Little Silver Point Rd., Little Silver, N.J. 07739; Rene St. Pierre, Laval, Canada

[73] Assignee: James D. Nolan, Little Silver, N.J.

[21] Appl. No.: 100,427

[22] Filed: Sep. 24, 1987

Related U.S. Application Data

[63] Continuation-in-part of Ser. No. 111, Jan. 2, 1987, abandoned.

[51] Int. Cl.[4] ..... H01J 9/24; H01J 61/35

[52] U.S. Cl. ..... 313/489; 313/635; 220/2.1 R; 427/67; 427/106; 445/8; 445/26; 445/58

[58] Field of Search ..... 313/112, 489, 493, 634, 313/635, 312, 317; 220/2.1 R; 427/67, 106; 445/8, 26, 58

[56] References Cited

U.S. PATENT DOCUMENTS 3,602,759 8/1971 Evans ..... 313/112

*Primary Examiner*—David K. Moore
*Assistant Examiner*—K. Wieder
*Attorney, Agent, or Firm*—R. Gale Rhodes, Jr.

[57] ABSTRACT

A fluorescent lamp including a glass envelope having first and second end caps at the opposite ends thereof and each end cap provided with a connecting pin, the glass envelope containing energization means for generating light emanating from the lamp and upon energization thereof a first portion of the glass envelope adjacent the first end cap and a second portion of the glass envelope adjacent the second end cap being heated to a first temperature and an intermediate glass portion intermediate the first and second glass portions being heated to a second temperature lower than the first temperature, and a composite safety coating including first and second substantially light transparent coatings and an intermediate substantially light transparent coating intermediate the first and second coatings, the first coating surrounding and secured to the first glass portion and including an outer end portion surrounding and secured to a portion of the first end cap not including the first connecting pin and including an inner end portion, the second coating surrounding and secured to the second glass portion and including an outer end portion surrounding and secured to a portion of the second end cap not including the second connecting pin and including an inner end portion, the intermediate coating surrounding and secured to the intermediate glass portion and including opposed end portions respectively adjacent and interconnected to the inner end portions of the first and second coatings, the first and second coatings light transparent and non-degradeable to at least the first temperature and the intermediate coating light transparent and non-degradeable to at least the second temperature, upon the glass envelope being broken into glass shards the composite coating maintaining the glass shards and the end caps in association to prevent broadcasting of the glass shards.

25 Claims, 3 Drawing Sheets

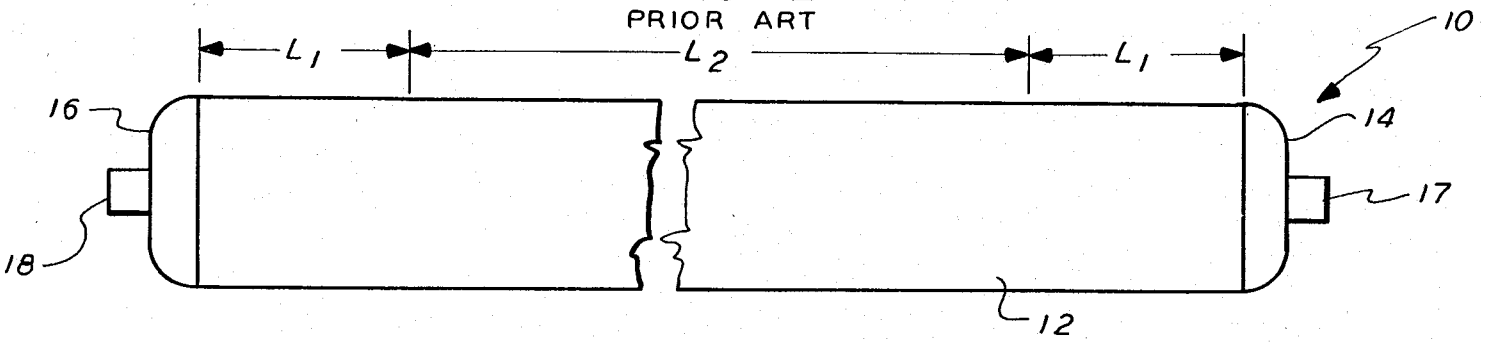
FIG. 1
PRIOR ART
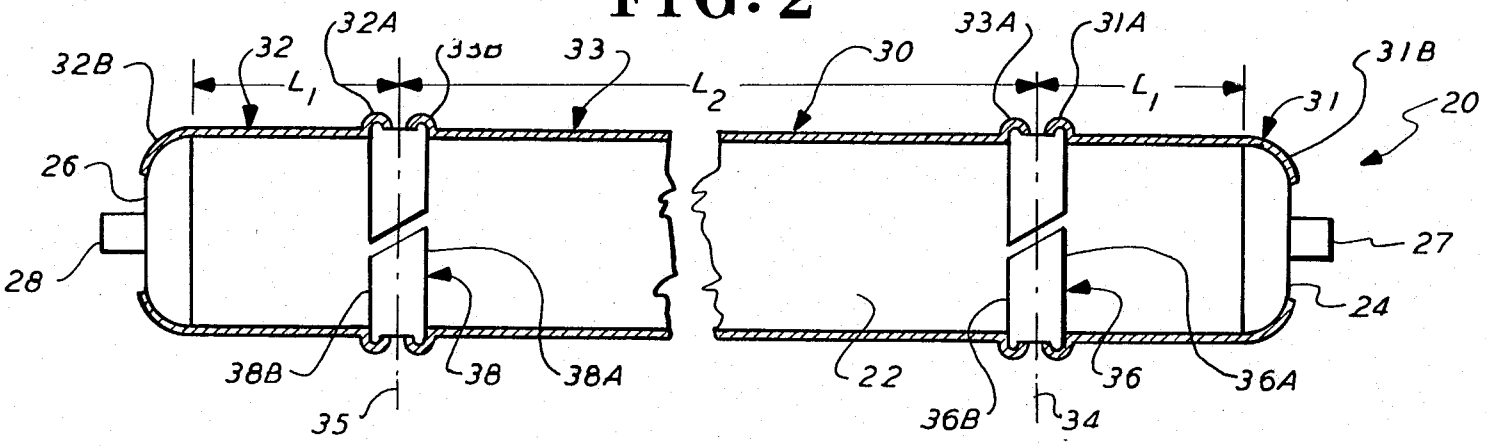
FIG. 2
FIG. 7
FIG. 6
FIG. 5
FIG. 4

20
22
24
26
27
28
80
82
83
140
141
142
143
146
148
151
153
155
157
161
162
165
171
172
177
178
$L_1$
$L_2$

ELECTRIC LAMP WITH COMPOSITE SAFETY COATING AND PROCESS OF MANUFACTURE

CROSS-REFERENCE TO RELATED APPLICATIONS

This application is a continuation-in-part of U.S. patent application Ser. No. 111 entitled ELECTRIC LAMP WITH COMPOSITE SAFETY COATING AND PROCESS OF MANUFACTURE filed on Jan. 2, 1987 in the names of James D. Nolan and Rene St. Pierre, now abandoned.

BACKGROUND OF THE INVENTION

This invention relates generally to the combination of an electric lamp and a safety coating for preventing broadcasting of glass shards upon the glass envelope of the lamp being broken, and more particularly relates to the combination of a composite safety coating and fluorescent lamps providing high light output and very high light output which fluorescent lamps are known in the art as HO and VHO fluorescent lamps; an example of such fluorescent lamp is the F96T12/CW/HO for 96", 1½" diameter Cool White High Output Lamp sold by Sylvania.

A diagrammatical illustration of a HO or VHO fluorescent lamp is shown in FIG. 1. The HO or VHO fluorescent lamp is indicated by general numerical designation 10 and includes a glass envelope 12 and end caps 14 and 16 provided at each end of the glass envelope and sealingly connected thereto in a manner known to those skilled in the art. The HO or VHO lamp, in the manner known to those skilled in the art, contains means (not shown) for generating high light output or very high light output upon energization of the lamp. As is still further known to those skilled in the art, upon such energization, the lengths of the glass envelope adjacent the end caps 14 and 26, identified in FIG. 1 as L1—L1, are heated to a first temperature much higher than the second temperature to which the middle length of the glass envelope indicated by L2 is heated. For example, in one embodiment each of an HO and a VHO fluorescent lamp, the lengths L1—L1 of the glass envelope adjacent the end caps were heated, respectively, to approximately 216° F. and 256° F. while the middle portion L2 of the glass envelopes of the HO and VHO fluorescent lamps were heated, respectively, to approximately 85°--90° F. In the HO and VHO fluorescent lamps, the length L1 measured approximately 2-½ inches irrespective of the length L2 of the middle portion of the lamps.

It has been found that this substantial difference in temperatures between the lengths of glass envelope L1—L1 adjacent the end caps and the middle portion of the glass envelope presents a difficult problem in providing the HO and VHO fluorescent lamps with a safety coating which is both effective in preventing broadcasting of glass shards upon the glass envelope 12 being broken and economically feasible with the cost of presently available electric lamp coating materials. This is due, primarily, to the substantial difference in the cost of electric lamp coating material which is non-degradeable to the higher temperatures to which the glass envelope lengths L1—L1 are heated and the cost of lamp coating material which is non-degradeable to the temperature to which the middle portion L1 of the lamp is heated; the term non-degradeable to a temperature means the temperature to which the coating material may be heated over the expected life of the lamp without the coating material melting, yellowing, or otherwise deteriorating and diminishing the amount of light that may be transmitted therethrough.

It has been found that Teflon produced by E.I. DuPont de Nemours & Company, Inc. is a suitable coating material for coating the lengths L1—L1 adjacent to the end caps of HO or VHO fluorescent lamps as the temperature to which Teflon is non-degradeable is well above the temperatures to which the glass envelope lengths L1—L1 are heated. However, since the present cost of Teflon is approximately $7.50 per foot of lamp coating, coating the entire length of a 96 inch or 8 foot HO or VHO fluorescent lamp with Teflon becomes economically infeasible due to the prohibitive cost of approximately $56.25 per fluorescent lamp. Surlyn, another plastic made by DuPont, is a suitable coating material for coating the middle portion L1 of the HO or VHO fluorescent lamps since Surlyn is non-degradeable well above the temperature to which the glass envelope length L2 is heated and since the present cost of Surlyn is only approximately $0.16 per foot of lamp coating. However, as is known, Surlyn degrades ruinously if heated to the higher temperatures to which the lengths L1—L1 of the glass envelope adjacent the end caps of the HO and VHO are heated.

Accordingly, it has been discovered that a composite safety coating for HO and VHO fluorescent lamps which includes a first coating of the more expensive material non-degradeable to the higher temperature for coating the glass envelope lengths L1—L1, and a second coating of the less expensive material which is non-degradeable to the lower temperature for coating the middle portion L2 of the HO and VHO fluorescent lamps, is needed. Thus, it has been discovered that a possible solution to this coating problem is to coat the shorter glass envelope lengths L1—L1 with Teflon and to coat the longer middle portion L2 with Surlyn, but as is further known to those skilled in the art, Teflon is a slick plastic to which other plastics, such as Surlyn, will not adhere or bond.

The teachings of the prior art are not instructive with regard to providing such a composite safety coating for HO and VHO fluorescent lamps, as such prior art teachings relate to the provision of a safety coating of a single material for preventing broadcasting of glass shards. Typical of such single material prior art safety coatings, and their process of manufacture, are those disclosed in U.S. Pat. No. 3,602,759, patented Aug. 31, 1978, George S. Evans, inventor; U.S. Pat. No. 3,621,323, patented Nov. 16, 1971, Frank W. Thomas, inventor; and U.S. Pat. No. 4,506,189, patented Mar. 19, 1985, James D. Nolan and Axel T. Karlsson, inventors.

Accordingly, there exists a need for a composite safety coating for HO and VHO fluorescent lamps which is both effective in preventing broadcasting of glass shards upon the glass envelope being broken and which is economically feasible with the present cost of electric lamp coating materials.

SUMMARY OF THE INVENTION

A fluorescent lamp including a glass envelope, a first end cap including a first connecting pin connected to one end of said glass envelope and a second end cap including a second connecting pin connected to the opposite end of said glass envelope, the glass envelope containing energization means for generating light emanating from the lamp and upon energization thereof a first portion of the glass envelope adjacent the first end cap and a second portion of the glass envelope adjacent the second end cap being heated to a first temperature and an intermediate glass portion intermediate the first and second glass portions being heated to a second temperature lower than the first temperature, and a composite safety coating including first and second substantially light transparent coatings and an intermediate substantially light transparent coating intermediate the first and second coatings, the first coating surrounding and secured to the first glass portion and including an outer end portion surrounding and secured to a portion of the first end cap not including the first connecting pin and including an inner end portion, the second coating surrounding and secured to the second glass portion and including an outer end portion surrounding and secured to a portion of the second end cap not including the second connecting pin and including an inner end portion, the intermediate coating surrounding and secured to the intermediate glass portion and including opposed end portions respectively adjacent and interconnected to the inner end portions of the first and second coatings, the first and second coatings non-degradeable to at least the first temperature and the intermediate coating non-degradeable to at least the second temperature, upon the glass envelope being broken into glass shards the composite coating maintaining the glass shards and the end caps in association to prevent broadcasting of the glass shards.

DESCRIPTION OF THE DRAWINGS

FIG. 1 is a diagrammatic illustration of an HO or VHO fluorescent lamp known to the prior art;

FIG. 2 is a diagrammatical illustration in cross-section of the combination of an HO or VHO fluorescent lamp and composite safety coating according to the present invention;

FIGS. 4–7 are views illustrating the various cross-sectional configurations of bridging or interconnecting members according to the present invention;

DESCRIPTION OF THE PREFERRED EMBODIMENT

Figure 8:
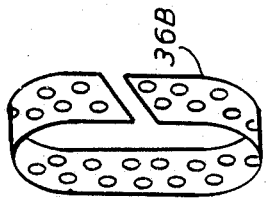
FIG. 8 is a perspective view of a perforated bridging or interconnecting member according to the present invention.

Referring now to FIG. 2, there is illustrated, diagrammatically, an embodiment of the present invention comprising in combination an HO or VHO fluorescent lamp indicated by general numerical designation 20 and including a glass envelope 22, bases or end caps 24 and 26 sealingly connected to each end of the glass envelope 22 and connecting pins 27 and 28, and a substantially light transparent composite safety coating indicated by general numerical designation 30 surrounding the lamp and for preventing broadcasting of glass shards upon the glass envelope 22 being broken. The composite safety coating 30 includes a first substantially transparent coating 31, a second substantially transparent coating 32 (which coating 32 may be the same as the first coating 31), and a third or intermediate substantially transparent coating 33, and first and second bridging or interconnecting members 36 and 38 respectively interconnecting the coatings 31, 32 and 33 as shown in the composite safety coating 30. The envelope 22, in the manner known to those skilled in the art, contains means (not shown) for generating high output (HO) light or very high output (VHO) light upon energization thereof, and upon such energization the shorter lengths L1—L1 of the glass envelope 22 adjacent the end caps 24 and 26 are heated to a much higher temperature (e.g. 216° and 256° F.) than the temperature (e.g. 85°–90° F.) to which the adjacent but more removed from the end caps longer middle length L2 of the glass envelope is heated.

The first substantially transparent coating 31 is non-degradeable to the noted higher temperature and surrounds and tightly engages the length L1 of the glass envelope 22, and includes an inner end portion 31A which surrounds and tightly engages the rightward or outer portion 36A of the bridging or interconnecting member 36 and includes an outer end portion 31B which surrounds and tightly engages a portion of the end cap 24, and which outer end portion 31B of the coating 31, in the preferred embodiment, extends slightly over the radiused portion of the end cap 24 as shown in FIG. 2. Similar to first coating 31, the second substantially transparent coating 32 is non-degradeable to the noted higher temperature and surrounds and tightly engages the leftward length L1 of the glass envelope 22, and includes an inner end portion 32A which surrounds and tightly engages the leftward or outer portion 38B of bridging or interconnecting member 38 and includes an outer portion 32B which surrounds and tightly engages a predetermined portion of the end cap 26; in the preferred embodiment, the outer end portion 32B of coating 32 extends slightly over the radiused portion of the end cap 26 as illustrated in FIG. 2. The third substantially transparent coating 33 is non-degradeable to the noted lower temperature and surrounds and tightly engages the middle length L2 of the glass envelope 22 and, as may be noted from FIG. 2, coating 33 includes opposed or rightward and leftward end portions 33A and 33B, respectively; the rightward end portion 33A of the third or intermediate coating 33 also surrounds and tightly engages the leftward or inner portion 36B of the bridging or interconnecting member 36, and the leftward end of the third or intermediate coating 33 surrounds and tightly engages the rightward or inner portion 38A of the bridging or interconnecting member 38. Due to such tight engagement between the coatings and the underlying portions of the fluorescent lamp (e.g. glass envelope and end caps) and the bridging or interconnecting members, and due to such interconnections between the coatings provided by the bridging or interconnecting members, a composite safety coating 30 is formed which maintains the glass shards in association with the end caps 24 and 26 upon the glass envelope 22 being broken. In the preferred embodiment the coatings 31 and 32 are of Teflon and the coating 33 is of Surlyn.

The bridging or interconnecting members 36 and 38, in the preferred embodiment, were a metal annulus or band of aluminum approximately 0.010 inch thick and approximately 0.75 inch wide, slit transversely as illustrated in FIG. 2 to permit thermal expansion. In accordance with the further teachings of the present invention, the bridging or interconnecting members may be provided with a cross-sectional configuration for enhancing connection with the first, second and third coatings 31, 32 and 33. More particularly, the opposed lateral or edge portions of the bridging or interconnecting members, for coating connection enhancement, may be extended upwardly as illustrated diagrammatically in FIG. 4, extended upwardly and inwardly in the various configurations further illustrated diagrammatically in FIGS. 5–7, or further alternatively, the bridging or interconnecting members may be provided with a cross-sectional configuration for providing enhanced interconnection with the coatings by being perforated as shown in FIG. 8 and illustrated by bridging member 39.

Still further in accordance with the teachings of the present invention, the coatings 31, 32 and 33 of FIG. 2 may be provided by the process of heat-shrinking as known to those skilled in the art wherein, for example, a sleeve of heat-shrinkable plastic is initially dimensioned and so oriented that it will fit loosely over the underlying portions of the fluorescent lamp 20 to be surrounded, and upon being heated, the sleeve will shrink or constrict and form a smooth tight-fitting coating or sheath that conforms the shape of the part of the fluorescent lamp 20 which it encloses or surrounds; suitable heat-shrinking processes for such-heat-shrinkable plastic sleeves are disclosed in the above-referenced U.S. Pat. No. 3,602,759 to Evans. The coatings 31 and 32 in accordance with the teachings of the present invention may be formed by such heat shrinking of Teflon sleeves into tight fitting engagement with the underlying or surrounded portions of the fluorescent tube 20, end caps 24 and 26 and bridging or interconnecting members 36 and 38 and the coating 33 may be formed by such heat shrinking of a Surlyn sleeve into tight fitting engagement with the underlying or surrounded portions of the fluorescent lamp 20 and bridging members 36 and 38.

Alternatively, and in the preferred embodiment, the coatings 31 and 32 were provided by such heat-shrink process with Teflon sleeves 0.20 inch thick and the middle or intermediate coating 33 was an integrally formed coating of substantially transparent Surlyn plastic formed in situ, 0.016 inch thick, and in accordance with the fluorescent lamp coating method or process disclosed in above-referenced U.S. Pat. No. 4,507,332 to Nolan et al., which patent is hereby incorporated by reference as if fully reproduced herein. Since, as noted above, Teflon is a slick plastic to which Surlyn will not adhere or bond, in accordance with the further teachings of the present invention, the coatings 31 and 32 of FIG. 2 were of Teflon and provided in accordance with the above-noted heat shrinking process, whereafter the entire fluorescent lamp 20 (except for the portions of the end caps and connecting pins which were masked off as taught in U.S. Pat. No. 4,507,332), including the heat-shrink Teflon coatings 31 and 32 were coated with an integrally formed coating of Surlyn formed in situ in accordance with the process set forth in U.S. Pat. No. 4,507,332, whereby the Surlyn is melted and fused to the underlying portion of the glass envelope 12 extending between the bridging members 36 and 38 but the Surlyn coating will not fuse to the underlying slick Teflon coatings 31 and 32; subsequently, the end portions of the Surlyn coating 33 covering the coatings 31 and 32 were trimmed, by suitable means, along the centerlines 34 and 35 (FIG. 2) of the bridging or interconnecting members 36 and 38, respectively, and the portions of the Surlyn coating 33 overlying the Teflon coatings 31 and 32 were readily removed or peeled away. The result is the composite safety coating 30 of FIG. 2 which, due to the tight heat-shrink engagement of the coatings 31 and 32 with the underlying glass envelope lengths L1–L2 and the bridging or interconnecting members 36 and 38 and the end caps 24 and 26, and due to the forming in situ or fusing of the Surlyn coating 33 to the glass envelope length L2 and the bridging members 36 and 38 as taught above, will maintain glass shards from the glass envelope 22 in association with the end caps 24 and 26 upon the glass envelope being broken and will thereby prevent broadcasting of the glass shards.

Figure 3:
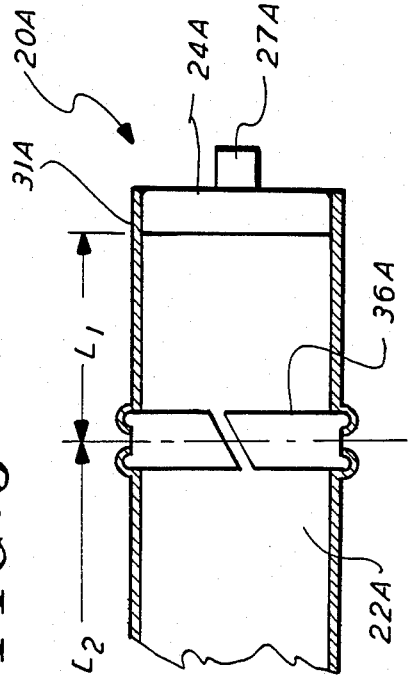
FIG. 3 is a partial view in cross-section of an alternate embodiment of the present invention.

Referring now to FIG. 3, there is illustrated an alternate embodiment of the present invention wherein the coating 31A surrounding and engaging the glass envelope length L1 of the HO or VHO fluorescent lamp 20A adjacent the end cap 24A, which length L1 is heated to the above-noted high temperature, extends not over the radiused portion of the end cap as illustrated in FIG. 2 but instead merely extends over the flat or cylindrical portion of the end cap 24A as shown in FIG. 3. This alternate embodiment is provided upon the heat shrinking of the coating 31A into sufficiently tight engagement with only the portion of the end cap 24A shown in FIG. 3 to provide in combination with the other coatings the composite safety coating of the present invention.

Figure 9:
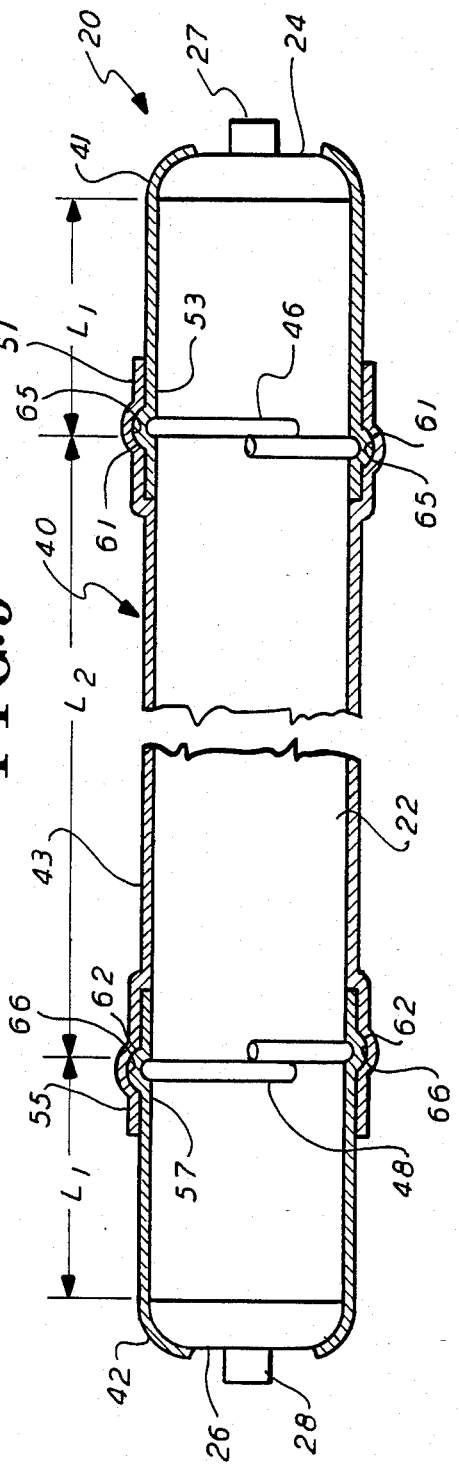
FIG. 9 is a diagrammatical illustration in cross-section of an alternate embodiment of the combination of an HO or VHO fluorescent lamp and composite safety coating according to the further teachings of the present invention.
Figure 10:
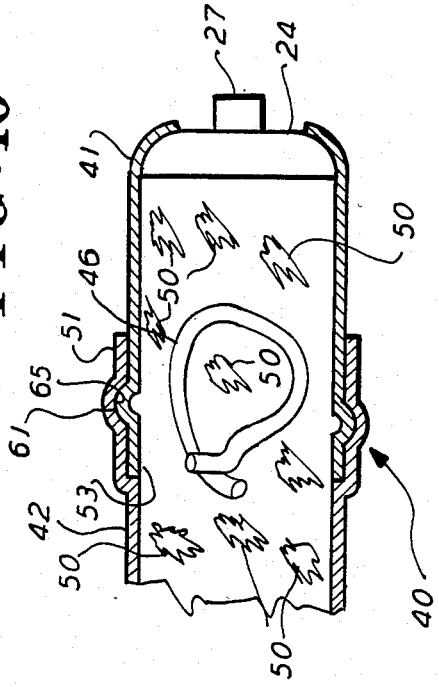
FIG. 10 is a partial view in cross-section of the embodiment of FIG. 9 illustrating the manner in which the composite safety coating maintains the coating in association with the end cap upon the glass envelope of the fluorescent lamp being broken thereby preventing broadcasting of glass shards.

REferring now to FIGS. 9 and 10, there is illustrated, diagrammatically, a further embodiment of the combination of an HO or VHO fluorescent lamp and composite safety coating according to the present invention; in FIGS. 9 and 10, for convenience of reference, the structure of the HO or VHO fluorescent lamp which is identical to the same structure shown in FIG. 2, and the lengths L1 and L2, are given identical numerical designations.

In this embodiment, the HO or VHO fluorescent lamp 20 is provided with a composite safety coating indicated by general numerical designation 40 which includes a first substantially transparent coating 41, a second substantially transparent coating 42 (which coating 42 may be the same as the first coating 41), and a third or intermediate substantially transparent coating 43, and wherein in this alternate embodiment the first and second bridging or interconnecting members interconnecting the coatings 41, 42 and 43 are embodied as generally annular members 46 and 48 of generally circular cross-sectional configuration and which, in one embodiment thereof and as illustrated in FIG. 9, each comprise one turn, or slightly more than one turn, of a relatively stiff wire of circular cross-sectional shape.

Generally, it will be understood that in this alternate embodiment the adjacent end portions of the coatings are overlapped as shown, i.e. the end portions of the intermediate coating 43 overlap the respective adjacent end portions of the coatings 41 and 42, and the annular members 46 and 48 impart to the overlapped adjacent end portions an interconnected configuration as shown.

Further generally, it will be understood that coatings 41 and 42 may be of the same material described above with regard to coatings 31 and 32 of FIG. 2 and may be formed by the same heat-shrink process described above, that the coating 42 may be of the same material described above with regard to coating 33 and may be formed by either of the same two processes, heat-shrinking or forming in situ described above with regard to the forming of coating 33, that the coatings surround and are secured to the underlying lengths of the glass envelope of the lamp and portions of the end caps, and that the coatings 41 and 42 are non-degradeable to the above-noted higher temperature and the coating 43 non-degradeable to the above-noted lower temperature.

More particularly, and in accordance with the further teachings of the invention, it will be noted from FIG. 9 that the rightward end portion 51 of intermediate coating 43 overlaps the adjacent inner end portion 53 of coating 41 and that the leftward end portion 55 of intermediate coating 43 overlaps the adjacent inner end portion 57 of coating 42. Further, it will be understood that upon the heat shrinking of the coatings 41 and 42 as described above, their respective adjacent inner end portions 53 and 57 will be heat shrunk over the annular members 46 and 48, respectively, thereby imparting to adjacent inner end portions 53 and 57 radially outwardly extending generally circular ridges 61 and 62; similarly, upon coating 43 being formed by either one of the two processes described above for forming coating 33 of FIG. 2, the adjacent end portions 51 and 55 of coating 43 will have radially outwardly extending circular grooves 65 and 66 imparted thereto by the annular members. By so forming, the grooves 65 and 66 and the ridges 61 and 62, the annular members 46 and 48, will underlie the overlapped adjacent end portions of the coatings and impart thereto the interlocked ridge and groove configurations. It will be noted, as shown in FIG. 9, that the circular ridges and grooves are generally concentric with respect to the annular member and that due to such forming, the circular ridges 61 and 62 are received within the circular grooves 65 and 66. As taught above with regard to the forming of coating 33 of FIG. 2, coating 43, formed in situ as described above, will be formed over the coatings 41 and 42 and subsequently trimmed back to the location illustrated in FIG. 9 with the outwardly extending end portions peeled away as taught above.

It has been further discovered, and in accordance with the still further teachings of the present invention and as illustrated diagrammatically in FIG. 10, that by forming coatings 41 and 42 of a more stiff or rigid or less flexible material than coating 43, upon the glass envelope 22 being broken and producing glass shards such as glass shards 50, and even upon an annular member such as annular member 46 being deformed such that it no longer engages the overlapped end portions having the interconnected ridges and grooves, the inner more rigid or stiff coating, such as coating 41, will expand radially outwardly maintaining the ridge 61 within the groove 65 to maintain the interconnection between the adjacent overlapped end portions 51 and 53 whereby the composite coating 40 maintains the glass shards 50 in association with the end caps, e.g. end caps 24, to prevent broadcasting of the glass shards. In one embodiment, coatings 41 and 42 were made of Teflon, coating 43 of Surlyn, to obtain the outwardly expanding benefits of the more stiff or rigid Teflon coating 41 with respect to the less stiff or more flexible coating 43 of Surlyn.

Figures 11, 12, 13, 14, 15:
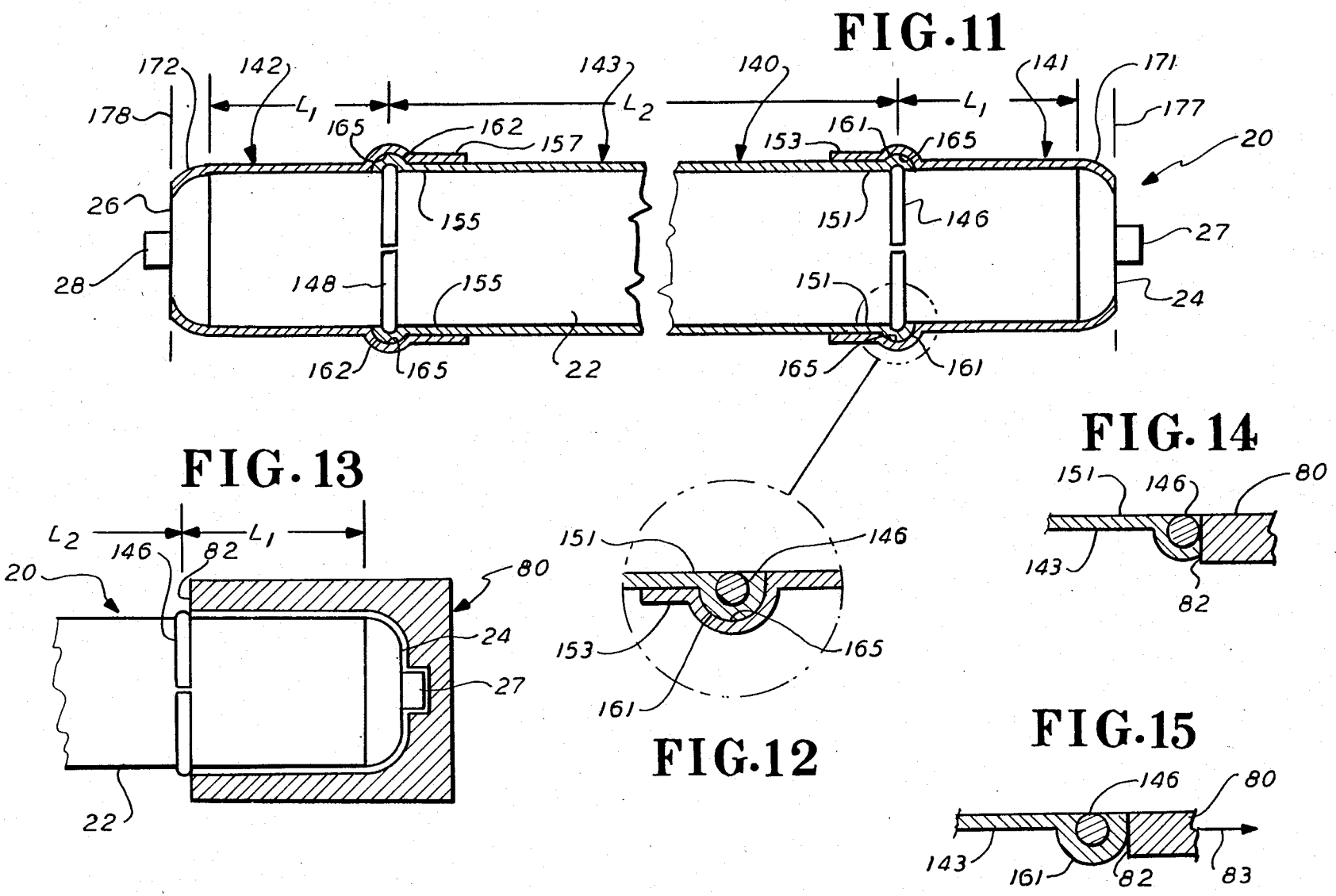
FIG. 11 is a diagrammatical illustration in cross-section of a further alternate embodiment of the combination of an HO or VHO fluorescent lamp and composite safety coating according to the further teachings of the present invention.
FIG. 12 is an enlarged view of an encircled portion of FIG. 11.
FIG. 13 is a partial view in cross-section illustrating diagrammatically an alternate embodiment of the coating process of the present invention.
FIGS. 14 and 15 are further diagrammatical illustrations, in cross-section, of the alternate coating process of the present invention.

Referring now to FIGS. 11–15, there is illustrated, diagrammatically, a still further embodiment of the combination of an HO or VHO fluorescent lamp 20 and composite safety coating 140 according to the present invention which is substantially transparent to light emanating from the fluorescent lamp and which upon the glass envelope of the fluorescent lamp being broken into glass shards maintains the glass shards and fluorescent lamp end caps in association thereby preventing broadcasting of the glass shards; in FIGS. 11–15, particularly FIG. 11, for convenience of reference, the structure of the HO or VHO fluorescent lamp which is identical to the same structure shown in FIGS. 2 and 9, and the lengths L1 and L2, are given identical numerical designations.

In this embodiment, the HO or VHO fluorescent lamp 20 is provided with the alternate embodiment composite safety coating indicated by general numerical designation 140 and which includes a first substantially light transparent coating 141, a second substantially light transparent coating 142 (which coating 142 may be the same as the first coating 141), and a third or intermediate substantially light transparent coating 143, and wherein in this alternate embodiment the first and second bridging or interconnecting members 146 and 148 interconnecting the coatings 141, 142 and 143, particularly the adjacent end portions thereof, are embodied as shown in FIG. 11 as generally annular members 146 and 148 of generally circular transverse cross-sectional configuration and which, in one embodiment thereof as illustrated in FIG. 11, each comprise a transversely split steel spring ring, split transversely to accommodate for thermal expansion of the glass envelope 22 of the fluorescent lamp 20 upon energization thereof.

Generally it will be understood that in this further alternative embodiment, particularly as compared to the alternative embodiment illustrated in FIG. 9, that the adjacent end portions of the coatings are overlapped oppositely to that illustrated in FIG. 9, i.e. the inner end portions of the coatings 141 and 142 overlap the adjacent end portions of the intermediate coating 143; however, in this embodiment the annular members 146 and 148, as did the annular members 46 and 48 of the embodiment illustrated in FIG. 9, impart to the overlapped adjacent end portions an interconnected configuration as shown.

Further generally, it will be understood that the first and second end coatings 141 and 142 may be of the same material described above with regard to the coatings 31 and 32 of FIG. 2 and coatings 41 and 42 of FIG. 9 and may be formed by the same heat-shrink process described above and in the preferred embodiment of Teflon, that the intermediate coating 143 may be of the same material described above with regard to coatings 33 and 43 and may be formed by the same two processes, e.g. heat shrinking or forming in situ described above with regard to the forming of coatings 33 and 43, that the coatings surround and are secured to the underlying lengths of the glass envelope of the fluorescent lamp 20 and portions of the end caps not including the connecting pins, and that the coatings 141 and 142 are light transparent and non-degradeable to the above-noted higher temperature and that the intermediate coating 143 is light transparent and non-degradeable to the above-noted lower temperature.

More particularly, and in accordance with the further teachings of the present invention, it will be noted that in the alternate embodiment of FIG. 11 that the inner end portion 153 of the coating 141 overlaps the adjacent rightward end portion 151 of the intermediate coating 143 and that the inner end portion 157 of the coating 142 overlaps the adjacent leftward end portion 155 of the intermediate coating 143.

Further, it will be understood that in the preferred embodiment the intermediate coating 143 is an integrally formed plastic coating formed in situ around the intermediate glass portion L2 of the glass envelope 22 to surround and engage the underlying intermediate glass envelope and to substantially surround and encapsulate the bridging or interconnecting annular members 146 and 148; the in situ forming process per se being the same as described hereinabove and as taught in the above-referenced Nolan et al. patent.

It will be further understood in accordance with the further teachings of the alternate embodiment process of the present invention in the forming of intermediate coating 143 that the glass envelope 22 (FIG. 11) is surrounded by the bridging or interconnecting members 146 and 148 at the respective transitions between the opposed end portions of the glass envelope heated to the higher temperature and indicated by lengths L1-L1, and the middle or intermediate glass portion indicated by length L2 heated to the above-noted lower temperature. Subsequently, as illustrated diagrammatically in FIG. 13 with regard to the rightward end of the fluorescent lamp 20, the rightward end portion of the fluorescent lamp, e.g. length L1, and the end cap 24 and connecting pin 27 are covered with a mask or masking member 80 (similarly the leftward end of the fluorescent lamp 20 but not shown) with the leftward or inner end portion 82 of the masking member 80, as better may be seen in FIG. 14, abutting the rightward or outer portion of the bridging or interconnecting member 146. Thereafter, as taught in the above-noted Nolan et al. patent, the glass envelope 22 and the unmasked portion of the bridging member 146 are exposed to a fluidized bed of powder of polymeric material, e.g. Surlyn, to apply a coating of such powder to the glass envelope 22 and to the unmasked portion of the bridging or interconnecting member 146, the mask 80 is retracted or moved rightwardly as illustrated in FIG. 15 in the direction of the arrow 83 and the powder is melted by heating to cause the powder to melt and flow around the bridging or interconnecting member 146 as illustrated in FIG. 15 to melt and fuse the powder to the glass envelope 22 and to melt and fuse the powder to the interconnecting or bridging member 146 with the bridging member 146 being substantially surrounded and encapsulated by the coating 143 as illustrated in FIG. 15; the process of substantially surrounding and encapsulating the interconnecting or bridging member 146 also provides the rightward end portion 151 of the intermediate coating 143 with the radially outwardly extending circular ridge 161 (FIGS. 12 and 15) and similarly provides the leftward end portion 155 of the intermediate coating 143 with the radially outwardly extending circular ridge 162 (FIG. 11). Thereafter, the masking member 80 is removed (similarly the masking member not shown on the leftward end of the fluorescent lamp 20 is removed) and the first and second coatings 141 and 142, which in the preferred alternate embodiment are heat-shrinkable sleeves of Teflon, are then heat-shrunk into the position shown in FIG. 11 by the heat-shrink process described above with the inner end portions 153 and 157 of the respective coatings 141 and 142 overlapping and tightly engaging the adjacent end portions 151 and 155 of the intermediate coating 143. Such heat shrinking provides the adjacent inner end portions 153 and 157 of the respective coatings 141 and 142 with the respective radially outwardly extending circular grooves 165 and 166 surrounding the ridges 161 and 162 of the opposed adjacent end portions of the intermediate coating 143 to interconnect the coatings and with the ridges and grooves being generally concentric with respect to the annular members 146 and 148. It has been discovered that in so forming the coatings 141, 142 and 143, and in so overlapping the respective adjacent end portions thereof with the interconnecting or interlocked ridges and grooves, upon the glass envelope 22 being broken into glass shards, the composite coating 140 comprised of the coatings 141, 142 and 143 maintains the end caps 24 and 26 and glass shards in association and prevents broadcasting of the glass shards.

It will be further understood, in accordance with the further teachings of the alternate embodiment of the present invention, that in this embodiment the outer end portions 171 and 172, respectively, of the coatings 141 and 142, are heat shrunk into engagement with the radiused portions of the end caps 24 and 26 to cause the ends of the outer end portions 171 and 172 of the coatings 141 and 142 to terminate in the planes indicated by lines 177 and 178 which are the planes in which the vertical ends or faces of the end caps 24 and 26 reside; this has been found to enhance the interconnecting of the connecting pins 27 and 28 into a fluorescent lamp receptacle while the fluorescent lamp is provided with the composite safety coating 140.

It will be understood by those skilled in the art that many modifications and variations may be made in the present invention without departing from the spirit and the scope thereof.

What is claimed is:

1. Fluorescent lamp with composite safety coating, comprising:

a fluorescent lamp including a glass envelope, a first end cap including a first connecting pin connected to one end of said glass envelope and a second end cap including a second connecting pin connected to the opposite end of said glass envelope, said glass envelope containing energization means for generating light emanating from said lamp and upon energization thereof a first portion of said glass envelope adjacent said first end cap and a second portion of said glass envelope adjacent said second end cap being heated to a first temperature and an intermediate glass portion intermediate said first and second glass portions being heated to a second temperature lower than said first temperature, and composite safety coating including first and second substantially light transparent coatings and an intermediate substantially light transparent coating intermediate said first and second coatings, said first coating surrounding and secured to said first glass portion and including an outer end portion surrounding and secured to a portion of said first end cap not including said first connecting pin and including an inner end portion, said second coating surrounding and secured to said second glass portion and including an outer end portion surrounding and secured to a portion of said second end cap not including said second connecting pin and including an inner end portion, said intermediate coating surrounding and secured to said intermediate glass portion and including opposed end portions respectively adjacent and interconnected to said inner end portions of said first and second coatings, said first and second coatings non-degradeable to at least said first temperature and said intermediate coating non-degradeable to at least said second temperature, upon said glass envelope being broken into glass shards said composite coating maintaining said glass shards and said end caps in association to prevent broadcasting of said glass shards.

2. Fluorescent lamp according to claim 1 wherein said composite coating includes interconnecting members at least partially surrounding said glass envelope substantially intermediate the respective transitions between said first and second glass portions and said intermediate glass portion and wherein said interconnecting members facilitate interconnection between said opposed end portions of said intermediate coating and said adjacent inner end portions of said first and second coatings.

3. Fluorescent lamp according to claim 2 wherein said interconnecting members have outer and inner portions, wherein said inner end portion of said first coating adjacent said intermediate coating surrounds and is secured to said outer portion of one of said interconnecting members and wherein one opposed end portion of said intermediate coating adjacent said first coating surrounds and is secured to said inner portion of said one interconnecting member, and wherein said inner end portion of said second coating adjacent said intermediate coating surrounds and is secured to said outer portion of the other of said interconnecting members and wherein the other opposed end portion of said intermediate coating adjacent said second coating surrounds and is secured to said inner portion of said other of said interconnecting members.

4. Fluorescent lamp according to claim 3 wherein each of said interconnecting members is a metal annulus slit transversely to permit thermal expansion thereof.

5. Fluorescent lamp according to claim 4 wherein said metal annulus is provided with a predetermined cross-sectional configuration for enhancing interconnection with said adjacent end portions of said coatings.

6. Fluorescent lamp according to claim 5 wherein said predetermined cross-sectional configuration is defined by opposed edge portions of said metal annulus which extend upwardly.

7. Fluorescent lamp according to claim 5 wherein said predetermined cross-sectional configuration is defined by opposed edge portions of said metal annulus extending upwardly and inwardly over said annulus.

8. Fluorescent lamp according to claim 5 wherein said predetermined cross-sectional configuration is defined by perforations extending through said annulus.

9. Fluorescent lamp according to claim 4 wherein said metal annulus is comprised of a band of aluminum approximately 0.010 inch thick and approximately 0.75 inch wide.

10. Fluorescent lamp according to claim 2 wherein said opposed end portions of said intermediate coating and said adjacent inner end portions of said first and second coatings are overlapped, and wherein said interconnecting members comprise generally annular members underlying said overlapped adjacent end portions and imparting thereto an interconnected configuration.

11. Fluorescent lamp according to claim 10 wherein said annular members have a generally circular cross-section, wherein said annular members impart radially outwardly extending circular ridges to ones of said overlapped adjacent end portions and impart radially outwardly extending circular grooves to the others of said overlapped adjacent end portions, wherein said ridges are received within said grooves to interconnect said overlapped adjacent end portions, and wherein said ridges and grooves are generally concentric with respect said annular members.

12. Fluorescent lamp according to claim 11 wherein said inner end portions of said first and second coatings have said ridges imparted thereto and wherein said opposed end portions of said intermediate coating overlap said adjacent inner end portions of said first and second coatings and have said grooves imparted thereto, and wherein said first and second coatings are more rigid than said intermediate coating whereby upon said glass envelope being broken and said composite coating being deformed said ridges tend to expand radially outwardly maintaining said ridges within said grooves to maintain said interconnection between said adjacent end portions to prevent said broadcasting of said glass shards.

13. Fluorescent lamp according to claim 12 wherein said first and second coatings comprise sleeves of substantially light transparent heat-shrinkable plastic heat-shrunk into engagement with said first and second glass portions and said portions of first and second end caps and with said inner end portions thereof heat-shrunk over and into engagement with said annular members to impart said circular ridges thereto, and wherein said intermediate coating comprises an integrally formed coating of substantially light transparent plastic formed in situ and surrounding and fused to said intermediate glass portion and with said opposed end portions thereof formed in situ and fused to and surrounding said circular ridges to impart said circular grooves thereto.

14. Fluorescent lamp according to claim 11 wherein said opposed end portions of said intermediate coating have said circular ridges imparted thereto, and wherein said inner end portions of said first and second coatings overlap said adjacent opposed end portions of said intermediate coating and have said circular grooves imparted thereto.

15. Fluorescent lamp according to claim 14 wherein said intermediate coating comprises an integrally formed coating of substantially light transparent plastic formed in situ and surrounding and fused to said intermediate glass portion and with said opposed end portions thereof formed in situ and fused to and substantially surrounding and encapsulating said annular members to impart said circular ridges thereto, and wherein said first and second coatings comprise sleeves of substantially light transparent heat shrinkable plastic heat-shrunk into engagement with said first and second glass portions and said portions of said first and second end caps and with said inner end portions thereof heat-shrunk over and into engagement with said circular ridges to impart said circular grooves thereto.

16. Fluorescent lamp according to claims 13 or 15 wherein said first and second coatings are heat-shrunk sleeves of heat shrinkable synthetic fluoropolymer resin.

17. Fluorescent lamp according to claims 13 or 15 wherein said intermediate coating is an integrally formed coating of ionomer resin formed in situ.

18. Process of providing a fluorescent lamp with a composite safety coating, said fluorescent lamp including a glass envelope having first and second end caps at the opposite ends thereof and each end cap provided with a connecting pin, upon said glass envelope being broken into glass shards said composite safety coating for maintaining said glass shards and said end caps in association to prevent broadcasting of said glass shards, said glass envelope containing energization means for generating light emanating from said lamp, and upon energization thereof first and second glass portions of said glass envelope respectively adjacent said first and second end caps being heated to a first temperature and an intermediate glass portion intermediate said first and second glass portions being heated to a second temperature lower than said first temperature, said process comprising the steps of:

coating said first and second glass portions and portions of said first and second end caps not including said connecting pins, respectively, with first and second substantially light transparent coatings non-degradeable to at least said first temperature, coating said intermediate glass portion with an intermediate substantially light transparent coating non-degradeable to at least said second temperature, said intermediate coating having opposed end portions and said first and second coatings having inner end portions respectively adjacent said opposed end portions of said intermediate coating; and interconnecting said opposed end portions of said intermediate coating respectively to said adjacent inner end portions of said first and second coatings.

19. Process according to claim 18 wherein said first and second coatings are provided by surrounding said first and second glass portions and said portions of said first and second end caps with sleeves of substantially light transparent heat-shrinkable plastic non-degradeable to at least said first temperature and heat shrinking said sleeves into engagement with said first and second glass portions and said portions of said first and second end caps.

20. Process according to claim 19 wherein said intermediate coating is provided by surrounding said intermediate glass portion with a sleeve of substantially light transparent heat-shrinkable plastic non-degradeable to at least said second temperature and heat shrinking said sleeve into engagement with said first glass portion.

21. Process according to claim 19 wherein said intermediate coating is provided by integrally forming said intermediate coating in situ from a plastic substantially transparent to light and non-degradeable to at least said second temperature.

22. Process according to claim 20 wherein said opposed end portions of said intermediate coating and said adjacent inner end portions of said first and second coatings are interconnected by surrounding said glass envelope at the respective transitions between said first and second glass portions and said intermediate glass portion with interconnecting members, surrounding outer portions of said interconnecting members respectively with said first and second plastic sleeves and heat shrinking said first and second plastic sleeves respectively into engagement with said outer portions of said interconnecting members and surrounding inner portions of said interconnecting members with said opposed end portions of said intermediate plastic sleeve respectively and heat shrinking said opposed end portions of said intermediate sleeve respectively into engagement with said inner portions of said interconnecting members.

23. Process according to claim 21 wherein said opposed end portions of said intermediate coating and said adjacent inner end portions of said first and second coatings are interconnected by the steps of:

surrounding said glass envelope at the respective transitions between said first and second glass portions and said intermediate glass portion with interconnecting members;

surrounding outer portions of said interconnecting members respectively with said first and second plastic sleeves and heat shrinking said first and second plastic sleeves respectively into engagement with said outer portions of said interconnecting members;

coating said intermediate glass portion, inner portions of said interconnecting members, and said first and second plastic sleeves with an integrally formed coating of substantially light transparent plastic non-degradeable to at least said second temperature formed in situ around said intermediate glass portion, said inner portions of said interconnecting members and said first and second heat shrunk sleeves; and subsequently removing said plastic coating formed in situ from said first and second heat shrunk sleeves and all but said inner portions of said interconnecting members.

24. Process according to claim 18 wherein said coating and interconnecting steps are provided by the steps of:

surrounding said glass envelope at the respective transitions between said first and second glass portions and said intermediate glass portion with annular interconnecting members, transversely split and of circular cross-section;

forming an integrally formed plastic coating in situ around said intermediate glass portion and substantially around said first and second interconnecting members to substantially surround and encapsulate said interconnecting members, said integrally formed plastic coating substantially transparent to light and non-degradeable to said second temperature, said integrally formed plastic coating comprising said intermediate coating and portions thereof substantially surrounding and encapsulating said interconnecting members comprising said opposed end portions of said intermediate coating; and surrounding said first and second glass portions and said portions of said end caps and said opposed end portions of said integrally formed intermediate coating, respectively, with first and second plastic sleeves substantially transparent to light and non-degradeable to at least said first said temperature and heat shrinking said first and second plastic sleeves respectively into engagement with said first and second glass portions and said portions of said first and second end caps and said opposed end portions of said integrally formed intermediate coating.

25. Process according to claim 24 wherein prior to said forming in situ step, said process includes the step of masking said first and second glass portions and said first and second end caps including said connecting pins.

* * * * *

UNITED STATES PATENT AND TRADEMARK OFFICE

CERTIFICATE OF CORRECTION

PATENT NO. : 4,804,886

DATED : February 14, 1989

INVENTOR(S) : Nolan et al.

It is certified that error appears in the above-identified patent and that said Letters Patent is hereby corrected as shown below:

Column 1, line 50, "2-½" should be -- 2-2½ --.

Signed and Sealed this

Fourth Day of July, 1989

*Attest:*

*Attesting Officer*

DONALD J. QUIGG

*Commissioner of Patents and Trademarks*